US010499749B2

(12) United States Patent
Burns

(10) Patent No.: US 10,499,749 B2
(45) Date of Patent: Dec. 10, 2019

(54) CONVERTIBLE CHILDREN'S WALKER

(71) Applicant: KIDS II, INC., Atlanta, GA (US)

(72) Inventor: Stephen R. Burns, Atlanta, GA (US)

(73) Assignee: KIDS2, INC., Atlanta, GA (US)

( * ) Notice: Subject to any disclaimer, the term of this patent is extended or adjusted under 35 U.S.C. 154(b) by 0 days.

(21) Appl. No.: 16/161,795

(22) Filed: Oct. 16, 2018

(65) Prior Publication Data

US 2019/0045945 A1 Feb. 14, 2019

Related U.S. Application Data

(63) Continuation of application No. 15/259,212, filed on Sep. 8, 2016, now Pat. No. 10,130,191.

(60) Provisional application No. 62/215,943, filed on Sep. 9, 2015.

(51) Int. Cl.
*A47D 13/04* (2006.01)

(52) U.S. Cl.
CPC ..... *A47D 13/04* (2013.01); *A47D 13/043* (2013.01)

(58) Field of Classification Search
CPC ..... A47D 13/04
See application file for complete search history.

(56) References Cited

U.S. PATENT DOCUMENTS 16,862 A 3/1857 Thomas
174,793 A 3/1876 Erikson
529,359 A 11/1894 Bradish
1,250,045 A 12/1917 Steinbach
2,884,046 A * 4/1959 Merlyn ..... A47D 1/06 280/47.35
3,145,999 A 8/1964 Burnham
3,204,367 A 9/1965 Stubbmann
3,427,071 A 2/1969 Pierson, Jr.
3,525,175 A 8/1970 Wolf
3,657,457 A 4/1972 Poynter
3,659,375 A 5/1972 Stubbmann
3,692,359 A 9/1972 Boucher
3,715,832 A 2/1973 Torres
4,165,127 A 8/1979 Vago
4,167,822 A 9/1979 Weir et al.
4,174,833 A 11/1979 Hennig et al.
4,208,831 A 6/1980 Strauss
4,270,306 A 6/1981 Klawitter
4,292,758 A 10/1981 Kuna et al.
4,573,936 A 3/1986 Wolf
4,575,070 A 3/1986 Kinberg et al.
4,594,072 A 6/1986 Cowell
4,822,030 A 4/1989 Cone
(Continued)

OTHER PUBLICATIONS

Graco Entertainer Activity Center Owner's Manual; 2001; 43 pgs.

*Primary Examiner* — John D Walters
*Assistant Examiner* — James J Triggs
(74) *Attorney, Agent, or Firm* — Gardner Groff & Greenwald, PC

(57) ABSTRACT

A convertible children's walker device includes a seated walker portion and a standing walker portion. The standing walker portion is detachably mounted to the seated walker portion in a first seated-support mode wherein the standing walker portion is used in combination with the seated walker portion, and the standing walker portion is detached from the seated walker portion in a standing-support mode of use independent of the seated walker portion.

23 Claims, 8 Drawing Sheets

(56) References Cited

U.S. PATENT DOCUMENTS

| | | | | |
|---|---|---|---|---|
| D301,440 | S | 6/1989 | Conley | |
| 4,844,209 | A | 7/1989 | Sedlack | |
| D305,108 | S | 12/1989 | Blumenthal | |
| D305,750 | S | 1/1990 | Cone | |
| 4,932,913 | A | 6/1990 | Raviv et al. | |
| 4,940,234 | A | 7/1990 | Ishida et al. | |
| 5,050,862 | A | 9/1991 | Saghafi | |
| 5,054,851 | A | 10/1991 | Chiu | |
| D321,384 | S | 11/1991 | Cheung et al. | |
| 5,071,149 | A | 12/1991 | Perego | |
| 5,106,102 | A | 4/1992 | Mitsumoto | |
| D326,123 | S | 5/1992 | Connon | |
| D328,624 | S | 8/1992 | Hu | |
| 5,203,581 | A | 4/1993 | Jankowski | |
| 5,407,246 | A | 4/1995 | Meeker et al. | |
| 5,441,289 | A | 8/1995 | Spielberger | |
| 5,462,300 | A | 10/1995 | Chien | |
| D374,896 | S | 10/1996 | Stroud et al. | |
| D375,283 | S | 11/1996 | Lu | |
| 5,590,892 | A | 1/1997 | Hu | |
| 5,688,211 | A | 11/1997 | Myers | |
| 5,700,201 | A | 12/1997 | Bellows et al. | |
| D397,166 | S | 8/1998 | Lai | |
| 5,788,253 | A | 8/1998 | Thomson et al. | |
| 5,794,936 | A | 8/1998 | Kakizaki | |
| D401,894 | S | 12/1998 | Cheng | |
| D402,931 | S | 12/1998 | Huang | |
| 5,845,963 | A | 12/1998 | Huang | |
| D403,715 | S | 1/1999 | Keegan et al. | |
| 5,938,218 | A | 8/1999 | Chuang | |
| 5,967,898 | A | 10/1999 | Takasaka et al. | |
| D417,417 | S | 12/1999 | Keegan et al. | |
| D424,126 | S | 5/2000 | Goes et al. | |
| D427,116 | S | 6/2000 | Keegan et al. | |
| D428,833 | S | 8/2000 | Chuang | |
| 6,161,860 | A | 12/2000 | Corneau | |
| 6,179,376 | B1 | 1/2001 | Meeker et al. | |
| 6,206,384 | B1 | 3/2001 | Chi et al. | |
| 6,231,056 | B1 | 5/2001 | Wu | |
| D443,233 | S | 6/2001 | Gaudet et al. | |
| 6,296,268 | B1 | 10/2001 | Ford et al. | |
| 6,299,247 | B1 | 10/2001 | Meeker et al. | |
| D450,634 | S | 11/2001 | Yang | |
| D451,052 | S | 11/2001 | Lu | |
| 6,461,238 | B1 | 10/2002 | Rehkemper et al. | |
| D466,843 | S | 12/2002 | Paesang et al. | |
| 6,513,869 | B1 | 2/2003 | Wu | |
| D475,661 | S | 6/2003 | Chuang | |
| 6,637,814 | B1 | 10/2003 | Bellows et al. | |
| 6,695,327 | B1 | 2/2004 | Maggiore et al. | |
| 6,805,604 | B2 | 10/2004 | Brumagin et al. | |
| 6,863,287 | B2 | 3/2005 | Myers et al. | |
| 6,976,677 | B1 | 12/2005 | McVicar | |
| 7,007,959 | B1 | 3/2006 | Lu | |
| 7,017,924 | B1 | 3/2006 | Lambert | |
| 7,025,364 | B1 * | 4/2006 | Clarke | A47D 13/04 280/47.38 |
| 7,037,168 | B2 | 5/2006 | Wu | |
| D528,479 | S | 9/2006 | Kende | |
| 7,244,165 | B2 | 7/2007 | Gubitosi et al. | |
| 7,287,768 | B2 | 10/2007 | Myers et al. | |
| 7,316,618 | B2 | 1/2008 | Hsu | |
| 7,347,432 | B2 | 3/2008 | Myers et al. | |
| D571,865 | S | 6/2008 | On | |
| D587,764 | S | 3/2009 | Cheng | |
| D589,851 | S | 4/2009 | Jane Santamaria | |
| D612,302 | S | 3/2010 | Cheng | |
| 7,740,560 | B2 | 6/2010 | Tadin et al. | |
| 7,819,410 | B2 | 10/2010 | Myers et al. | |
| D627,009 | S | 11/2010 | Lu | |
| D630,259 | S | 1/2011 | Lu | |
| D641,798 | S | 7/2011 | Latham | |
| 8,302,978 | B2 | 11/2012 | You et al. | |
| D679,337 | S | 4/2013 | Lai | |
| 8,517,403 | B2 | 8/2013 | Jessie, Jr. | |
| D694,676 | S | 12/2013 | Lai | |
| D702,599 | S | 4/2014 | Lu | |
| 9,033,351 | B2 | 5/2015 | Sejnowski et al. | |
| 9,192,247 | B1 * | 11/2015 | Lu | A47D 13/043 |
| 9,375,097 | B2 | 6/2016 | Stango et al. | |
| 9,610,211 | B2 * | 4/2017 | Lai | A61H 3/008 |
| 2002/0043825 | A1 | 4/2002 | Bellows et al. | |
| 2003/0162597 | A1 | 8/2003 | Horchler | |
| 2003/0184036 | A1 | 10/2003 | Wu | |
| 2004/0075231 | A1 | 4/2004 | Hou et al. | |
| 2008/0070197 | A1 | 3/2008 | Yu | |
| 2008/0113581 | A1 | 5/2008 | Jazenski et al. | |
| 2008/0191446 | A1 | 8/2008 | Chow | |
| 2010/0078909 | A1 | 4/2010 | Cheng | |
| 2012/0089275 | A1 | 4/2012 | Yao-Chang et al. | |
| 2013/0295817 | A1 | 11/2013 | Weber et al. | |

* cited by examiner

CONVERTIBLE CHILDREN'S WALKER

CROSS-REFERENCE TO RELATED APPLICATION

This application is a continuation of U.S. Non-Provisional patent application Ser. No. 15/259,212 filed Sep. 8, 2016, which claims the priority benefit of U.S. Provisional Patent Application Ser. No. 62/215,943 filed Sep. 9, 2015, the entireties of which are hereby incorporated herein by reference for all purposes.

TECHNICAL FIELD

The present invention relates generally to the field of children's toys and accessories, and more particularly to a walker activity device for children, which is convertible between a seated-support walker mode and a standing-support walker mode using a standing walker portion that is detachable from a seated walker portion.

BACKGROUND

Various support devices such as walkers and bouncers are known for use with toddlers and small children as they develop their walking skills. Many such devices typically lack sufficient entertainment and interactivity features to maintain a child's attention and interest over time, and/or are have utility for only very limited stages of a child's development. For example, typical seated walkers may no longer be of interest or use to a toddler who has begun learning to walk independently.

Accordingly, it can be seen that needs exist for children's support devices capable of maintaining a child's attention and interest over longer spans of their development, and/or for use by a child in different modes and in different stages of development. It is to the provision of a children's walker device meeting these and other needs that the present invention is primarily directed.

SUMMARY

In example embodiments, the present invention provides a children's walker activity device capable of maintaining a child's attention and interest over longer spans of their development, and/or for use by a child in different modes and in different stages of development. Example embodiments of the walker device are convertible between a seated-support walker mode and a standing-support walker mode, and include a standing walker portion that is detachable from a seated walker portion. In example embodiments, both the standing walker portion and the seated walker portion are usable by the child independently of the other portion. Various entertainment features are optionally provided, for example by stylization in the form of an automobile, pickup truck, or other vehicle or transport mechanism.

In one aspect, the present invention relates to a convertible children's walker device. The walker device preferably includes a seated walker portion and a standing walker portion. The standing walker portion is preferably detachably mounted to the seated walker portion in a first seated-support mode wherein the standing walker portion is used in combination with the seated walker portion, and wherein the standing walker portion is detached from the seated walker portion in a standing-support mode of use independent of the seated walker portion.

Optionally, the seated walker portion is usable in a second seated-support mode, independent of the standing walker portion, when the standing walker portion is detached from the seated walker portion.

In another aspect, the invention relates to a convertible children's walker device. The walker device preferably includes a seated walker portion having a wheeled base, a seat platform, and a support frame extending between the wheeled base and the seat platform. The walker device preferably also includes a standing walker portion comprising a generally U-shaped body having a front portion, left and right side portions, and an open rear section defining a clear space between the left and right side portions. The standing walker portion is detachably mounted to the seated walker portion in a first seated-support mode wherein the standing walker portion is used in combination with the seated walker portion, and the standing walker portion is detached from the seated walker portion in a standing-support mode of use independent of the seated walker portion.

In still another aspect, the invention relates to a convertible children's walker device. The walker device preferably includes a seated walker portion comprising a wheeled base, a seat platform, and a support frame extending between the wheeled base and the seat platform, the seat platform including first sliding engagement elements. The walker device preferably also includes a standing walker portion having a generally U-shaped body with a front portion, left and right side portions, and an open rear section defining a clear space between the left and right side portions. The standing walker portion preferably also includes a plurality of rolling wheels, and second sliding engagement elements configured to cooperatively engage with and detach from the first sliding engagement elements of the seated walker portion. In a first seated-support mode the standing walker portion is detachably mounted to the seated walker portion by engagement of the first and second sliding engagement elements, and in a standing-support mode of use the standing walker portion is detached from and usable independently of the seated walker portion.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
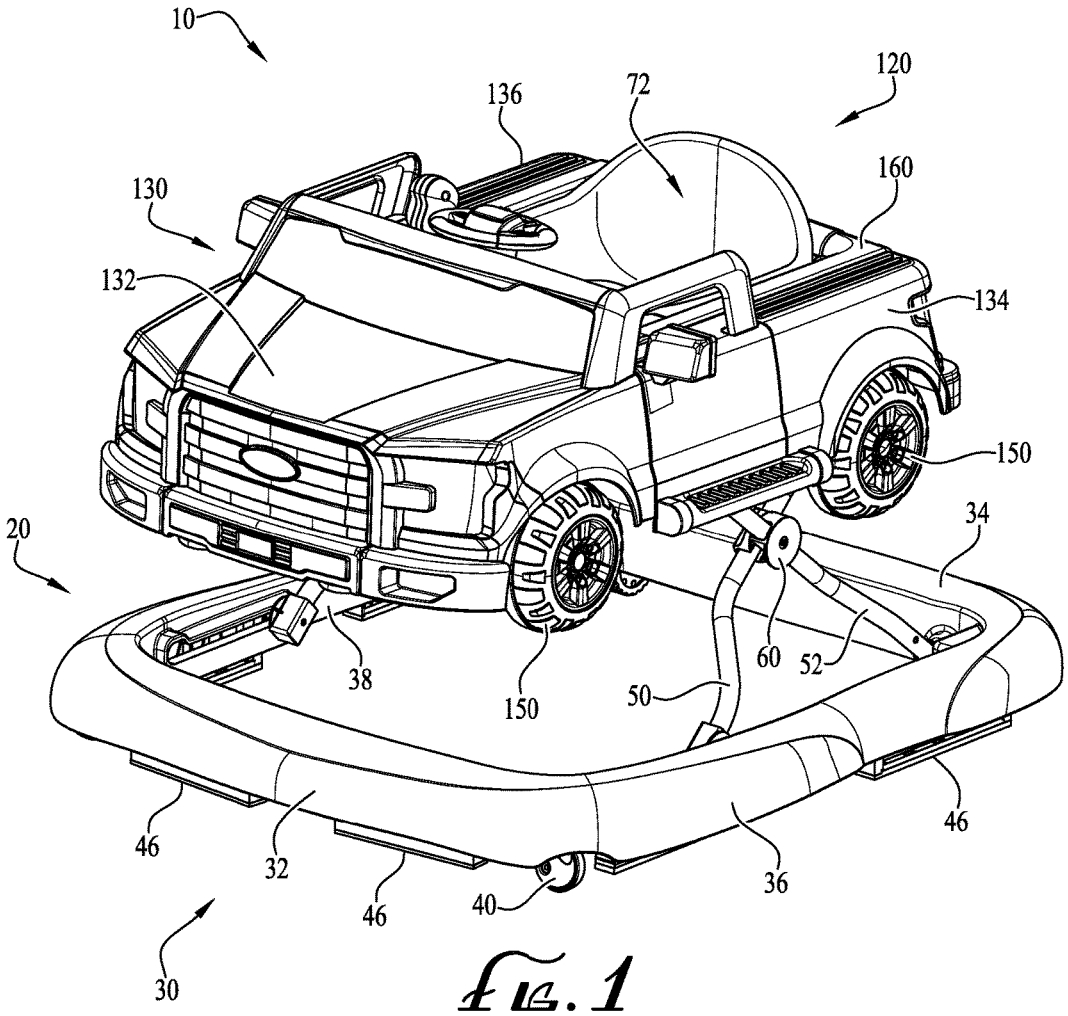
FIG. 1 is a perspective view of a children's walker device according to an example embodiment of the present invention, with a standing walker portion coupled to a seated walker portion, in a first seated-support mode of use.
Figure 2:
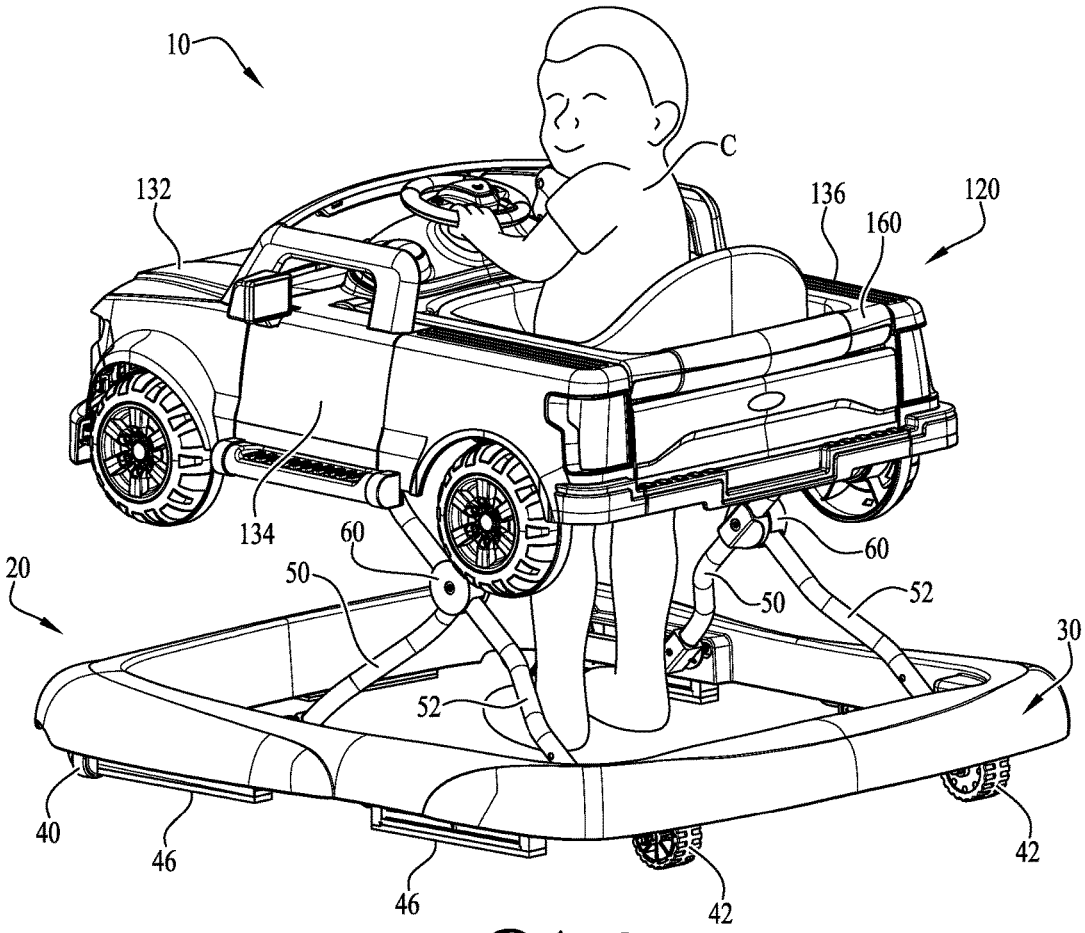
FIG. 2 is another perspective view of the children's walker device of FIG. 1, showing a child seated therein in the first seated-support mode of use.

With reference now to the drawing figures, wherein like reference numbers represent corresponding parts throughout the several views, FIGS. 1-6 show example embodiments and modes of use of a children's walker activity and support device 10. In example forms, the walker device 10 generally comprises a seated walker portion 20 and a standing walker portion 120. In a first or combined seated-support mode of use shown in FIGS. 1 and 2, the standing walker portion 120 is mounted to and supported on the seated walker portion 20. As shown in FIG. 2, a toddler or child C can use the device 10 supported in a seated position with their feet free to push against the floor or other underlying support surface to move around while developing leg strength, balance and coordination as they learn to walk.

Figure 3:
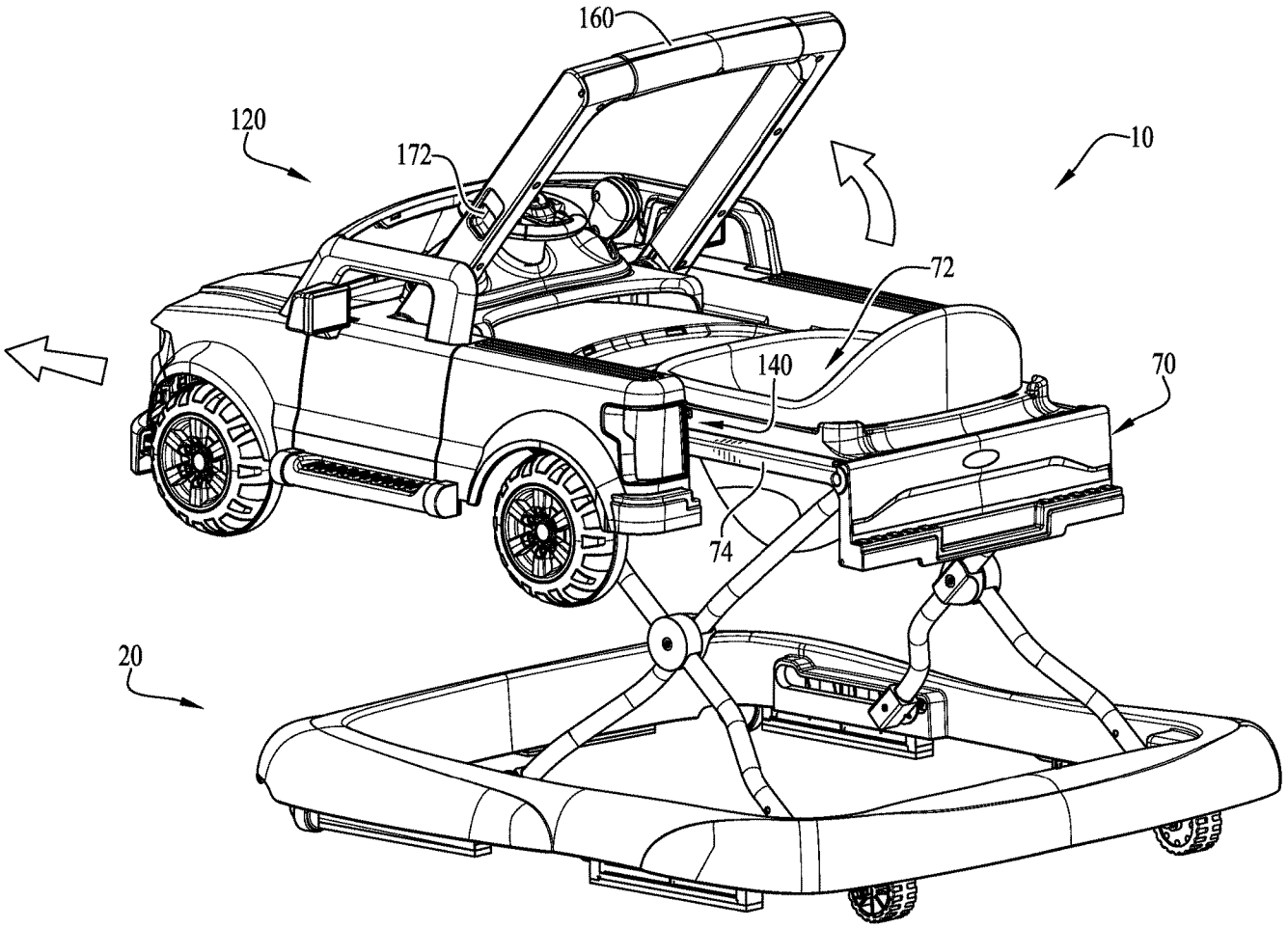
FIG. 3 shows conversion of the children's walker device of FIG. 1 from the first seated-support mode of use, by detachment of the standing walker portion from the seated walker portion for separate independent modes of use.
Figure 4:
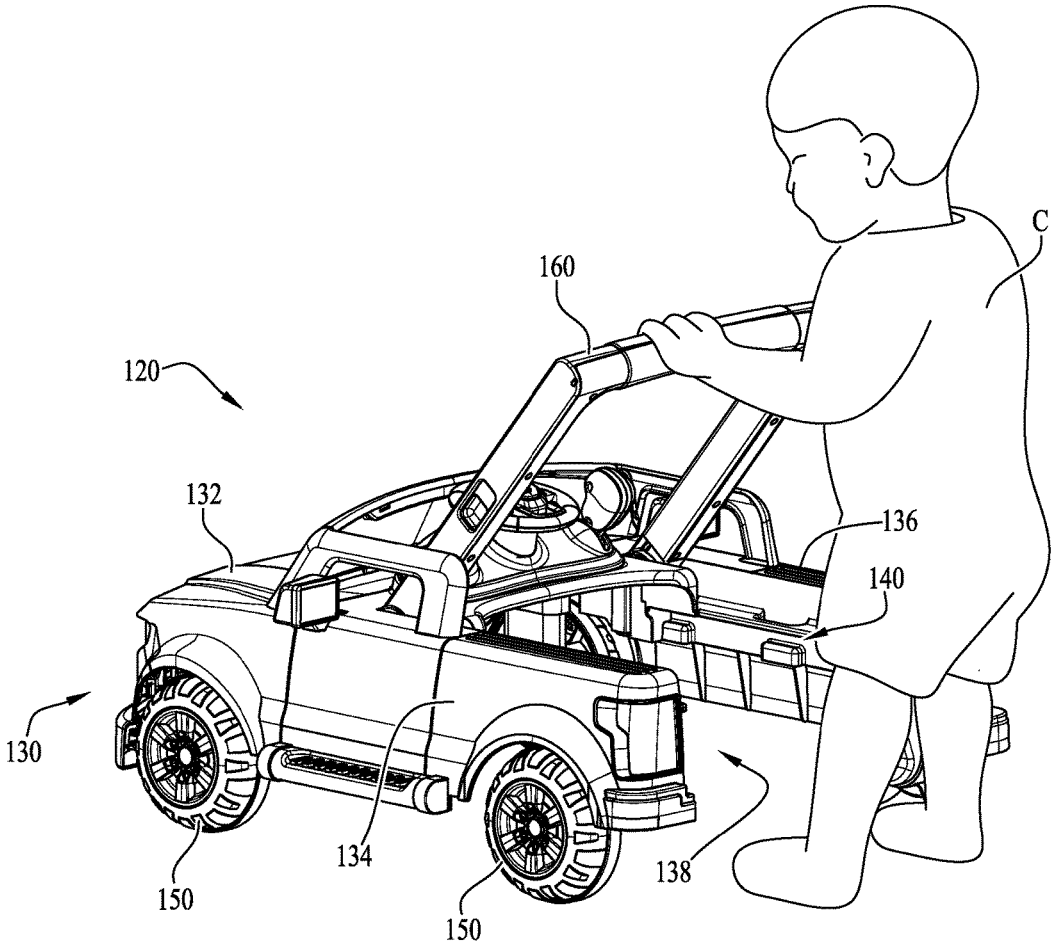
FIG. 4 shows the standing walker portion of the children's walker device of FIG. 1, used by a child in a standing-support mode of use independent of the seated walker portion.
Figure 5A:
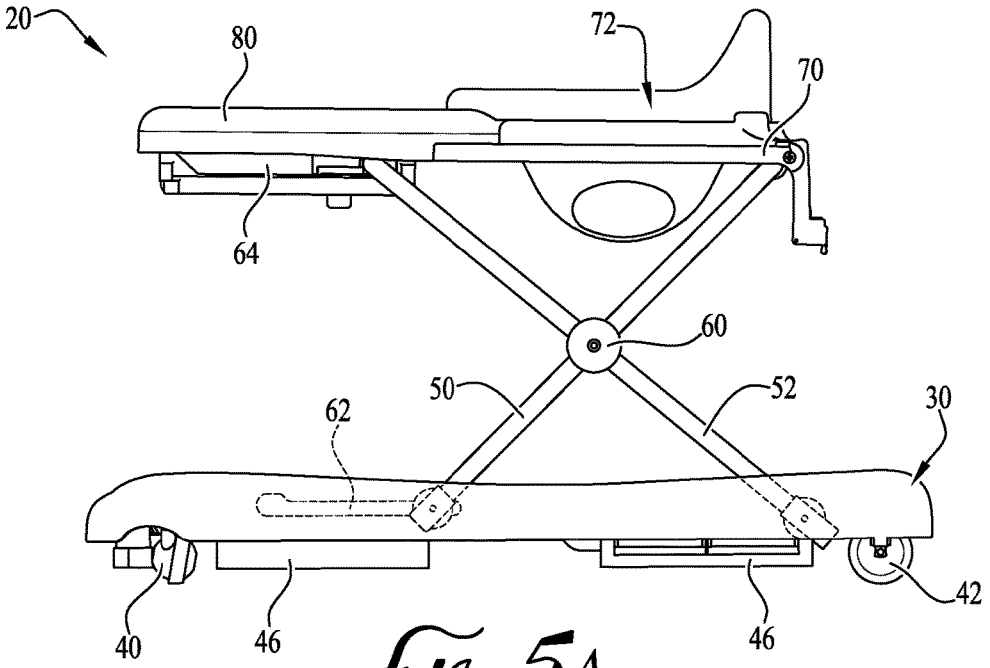
FIG. 5A shows the seated walker portion of the children's walker device of FIG. 1 in a second seated-support mode of use independent of the standing walker portion.

The walker device 10 is preferably convertible to one or more additional independent modes of use, for example by detachment of the standing walker portion 120 from the seated walker portion 20, as shown in an example mode of detachment or separation in FIG. 3. For example, FIG. 4 shows a child C using the standing walker portion 120 independent of the seated walker portion 20, in a standing-support mode wherein the child walks behind the standing walker portion 120 using the standing walker portion for balance and support if needed, after developing sufficient strength to do so to further develop their walking skills. FIG. 5A shows the seated walker portion 20 in a second seated-support mode of use, independent of the standing walker portion 120, whereby a child can use the seated walker portion in typical fashion after the standing walker portion has been detached.

In the depicted embodiment, the seated walker portion 20 includes a wheeled carriage comprising a generally rectangular base 30 having a front panel 32, a rear panel 34, and left and right side panels 36, 38, with an open interior space defined therein and substantially enclosed by the base. The wheeled carriage of the seated walker portion 20 preferably further comprises rolling support members coupled to the underside of the base 30, such as pivotal caster wheels 40 at front corners of the base and straight rolling wheels 42 at rear corners of the base. One or more contact bumpers 46 are optionally provided along the underside of the base 30 to act as stops if a rolling support member drops below the support surface, for example on uneven terrain or at stairs. In alternative embodiments, the base 30 comprises rocker portions along the underside of the left and right side panels 36, 38 rather than rolling support members, allowing the device 10 to function as a children's rocker rather than a walker.

A cross-member support frame including first and second support arms 50, 52 extends upwardly from the left and right side panels 36, 38 of the base 30 to support a seat platform 70. The seat platform 70 preferably includes a support seat 72, for example in the form of a saddle or sling having leg openings through with the legs of a child seated therein can extend to reach the ground or other support surface upon which the wheeled carriage of the base 30 is supported, allowing the child to move the walker device. The seat platform 70 optionally further comprises a tray 80, for example for holding toys, food or other items in a location accessible by the child seated in the support seat 72. In alternative embodiments, the support seat is part of the standing walker portion 120, and is detachable from the seated walker portion 20.

In example embodiments, the support frame between the base 30 and the seat platform is collapsible to a compact position for storage or transport when not in use. For example as seen best in FIGS. 5A and 5B, in the depicted embodiment the first and second support arms 50, 52 are connected at medial portions thereof by pivotal hubs 60, which allow the support arms to pivot and fold relative to one another. The lower front ends of the first support arms 50 are slidably mounted within lower tracks or slots 62 extending laterally along forward inside portions of the left and right side panels 36, 38 of the base 30; and the upper front ends of the second support arms 52 are slidably mounted within upper tracks or slots 64 extending laterally along forward left and right side portions of the seat platform 70 beneath the tray 80. The upper rear ends of the first support arms 50 are pivotally coupled to rearward portions of the seat platform 70; and the lower rear ends of the second support arms 52 are pivotally coupled to rearward portions of the left and right side panels 36, 38 of the base 30. Locking or latching mechanisms requiring adult operation are preferably provided to retain the support frame securely in its expanded or use configuration (FIG. 5A) while in use, and allowing release when the child is not seated therein to collapse the frame into its compact or folded configuration (FIG. 5B) for storage or transport when not in use. In example embodiments, the frame of the seated walker portion 20 can be folded and unfolded with or without the standing walker portion 120 mounted to the seated walker portion. In further example embodiments, the frame of the seated walker portion optionally provides height adjustment allowing selective variation of the vertical elevation of the seat platform 70 above the floor.

The standing walker portion 120 preferably comprises a generally U-shaped or C-shaped body portion 130 having a front portion 132, left and right side portions 134, 136, and an open rear section 138 defining a clear space between the left and right side portions that is not enclosed along the rear side. In the depicted embodiment, four rolling wheels 150 are rotationally mounted at the front and rear of each side of the body portion 130, allowing the standing walker portion 120 to roll along the floor or other support surface upon which it is placed, when removed from the seated walker portion 20 for independent use in the standing-support mode (FIG. 4). In alternate embodiments, fewer or more than four wheels 150 can be provided, for example three, six or other numbers of wheels configured in an array to provide support in use. In example embodiments, the body 130 of the standing walker portion 120 is configured and stylized to have the appearance of an automobile, pickup truck, or other vehicle. For example, the body 130 can include panels or surfaces having the appearance of a hood, windshield, doors, bed, bumpers, side panels, rearview mirrors, steering wheel, lights, and/or other components of a vehicle. The body 130 can optionally include light and/or sound features such as for example turn signals, headlights, tail-lights, an audible horn, a radio or other audio device, speakers and electronic audio source to produce an engine sound; and child-operable controls such as for example a horn actuator, a start button to initiate the engine sound, light switches, turn signal actuator, and the like.

Figure 6A:
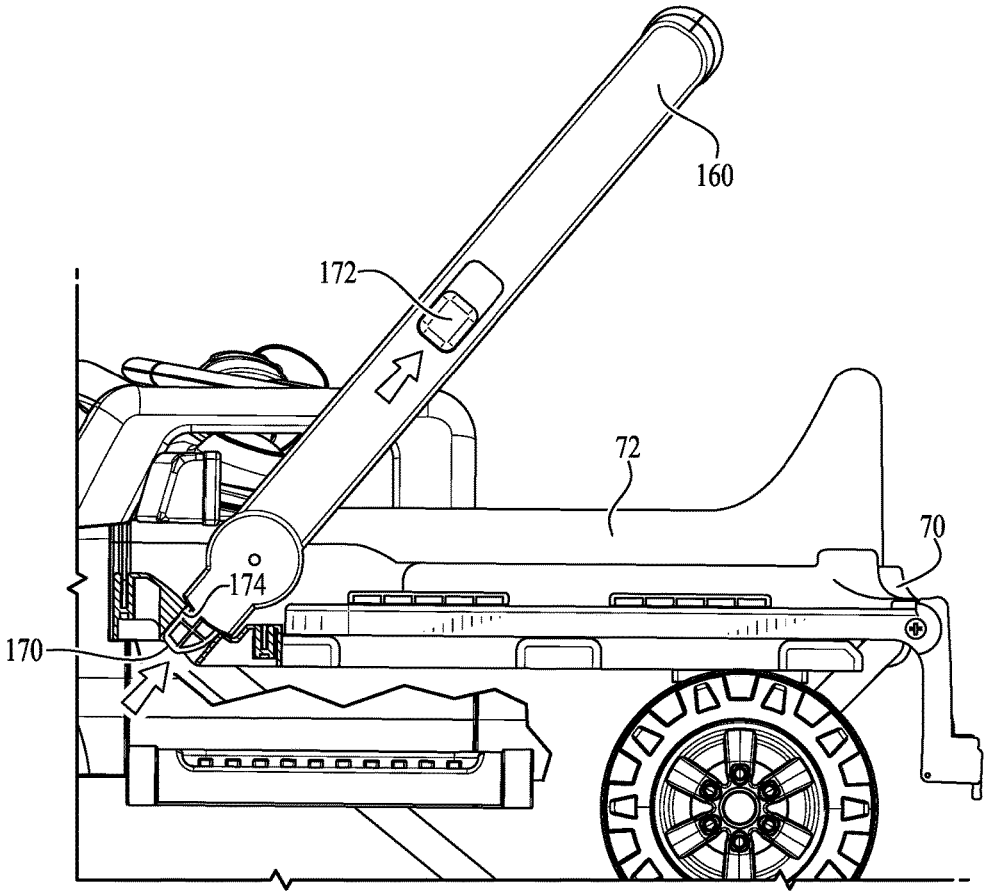
FIGS. 6A, 6B and 6C show a sequence of articulation of a handle portion of the standing walker portion of the children's walker device of FIG. 1.
Figure 6B:
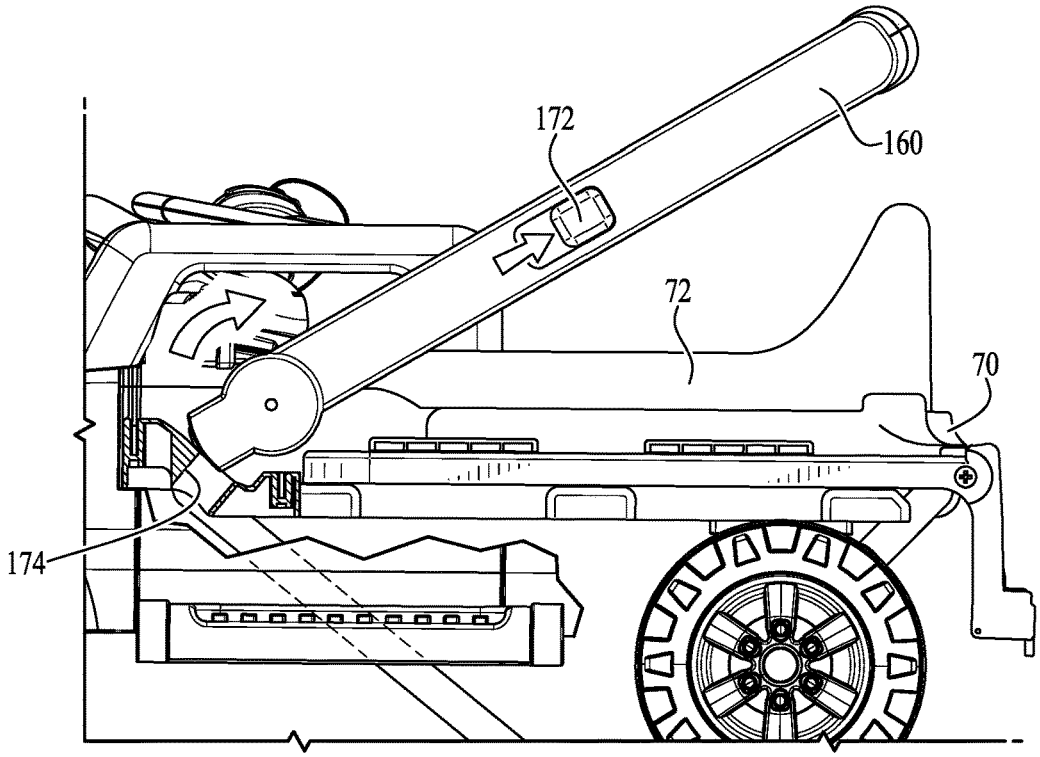
Figure 6C:
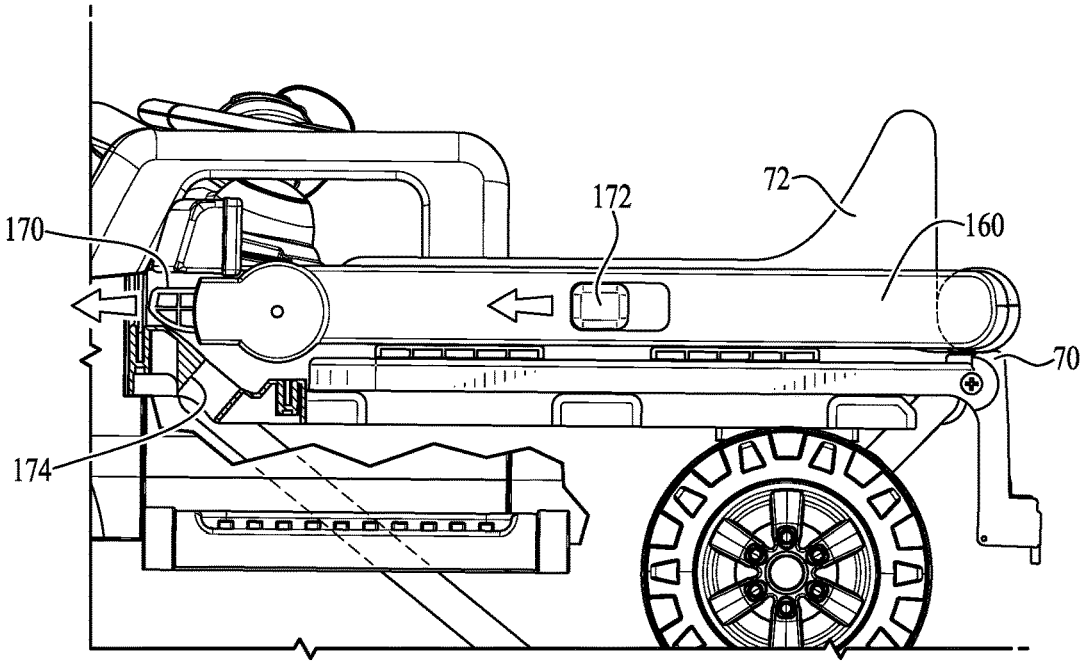

The standing walker portion 120 preferably further comprises a generally U-shaped or C-shaped handle 160 pivotally attached to the body portion 130. As seen best with reference to FIGS. 6A, 6B and 6C, the handle 160 pivots between a raised or upright position (FIG. 6A) and a lowered position (FIG. 6C), about a pivot point or hinge at or near the intersections of the left and right side portions 134, 136 and the front portion 132 of the body 130. FIG. 6B shows the handle 160 in an intermediate position between the raised and lowered positions.

A releasable latching mechanism is preferably provided to securely retain the handle 160 in its raised position to provide sturdy support for a child in the standing-support mode (FIG. 4), and optionally also for biasing the handle toward the lowered position when released and lowered to retain the standing walker portion 120 in place on the seated walker portion 20 in the first seated support mode (FIGS. 1 and 2). In example embodiments, the latching mechanism comprises retractable strut(s) 170 mounted to extend and retract axially within one or both side arms of the handle 160, which are spring-biased toward their extended positions (FIG. 6A). The retractable strut(s) 170 are coupled to release actuator(s) 172 accessible along the sides of one or both side arms of the handle 160, allowing an adult caregiver to release the latch mechanism to lower the handle 160. In example embodiments, latch struts 170 and release actuators 172 are optionally provided on both side arms of the handle 160 requiring two-handed operation to release and lower the handle, to prevent inadvertent release. In the raised and latched position (FIG. 6A), flat side surfaces of the extended latch struts 170 abut solidly against fixed shoulders 174 within the body 130 to hold the handle in its raised position and resist lowering. Operating the release actuators 172 by pulling them rearward retracts the latch struts 170 into the side arms of the handle 160, releasing the latch struts from the abutment shoulders 174, and allowing the handle to be lowered (FIG. 6B). In the lowered position (FIG. 6C), the actuators 172 are released, and inclined or arcuate contact faces of the latch struts 170 extend into contact with the abutment shoulders 174 or other contact surfaces within the body 130 to bias the handle 160 in the direction of its lowered position. In example forms, the inclined or arcuate contact faces of the latch struts 170 function as a cam surface against the abutment shoulders 174 or other contact surfaces, to retract the latch struts as the handle is raised, without requiring the user to operate the release actuators 172.

In its raised position (FIG. 6A), the handle 160 functions as a support grip for a child C using the standing walker portion 120 independently of the seated walker portion 20 in the standing-support mode (FIG. 4), to provide balance and support as needed while the child develops their walking skills. In its lowered position (FIG. 6C), the handle 160 functions to retain the standing walker portion 120 in place when mounted on the seated walker portion 20 in the first seated-support mode (FIGS. 1 and 2).

Figure 7A:
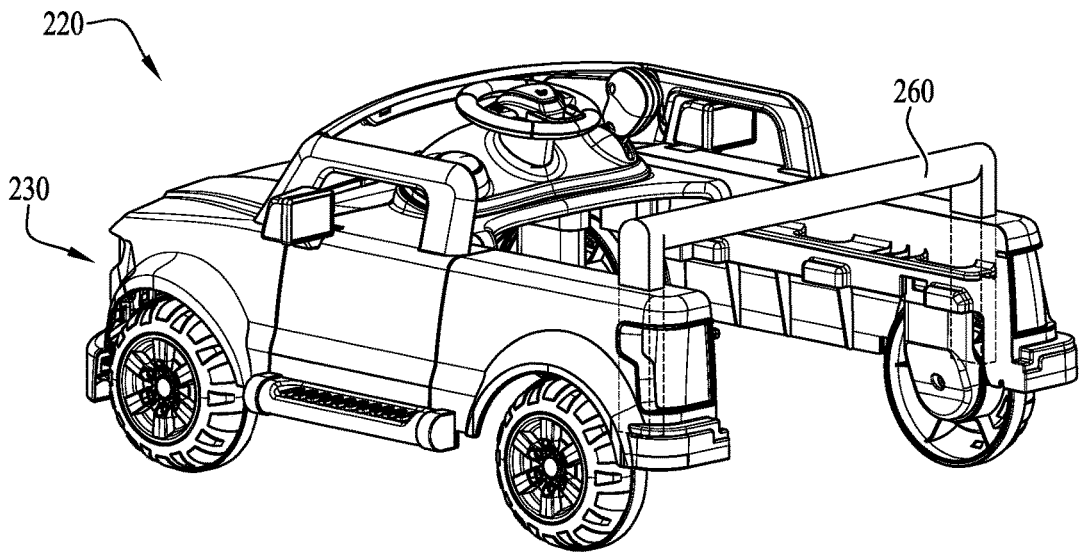
FIGS. 7A and 7B show a children's walker device according to another example embodiment of the present invention, having a sliding or telescoping handle translationally mounted to the walker.
Figure 7B:
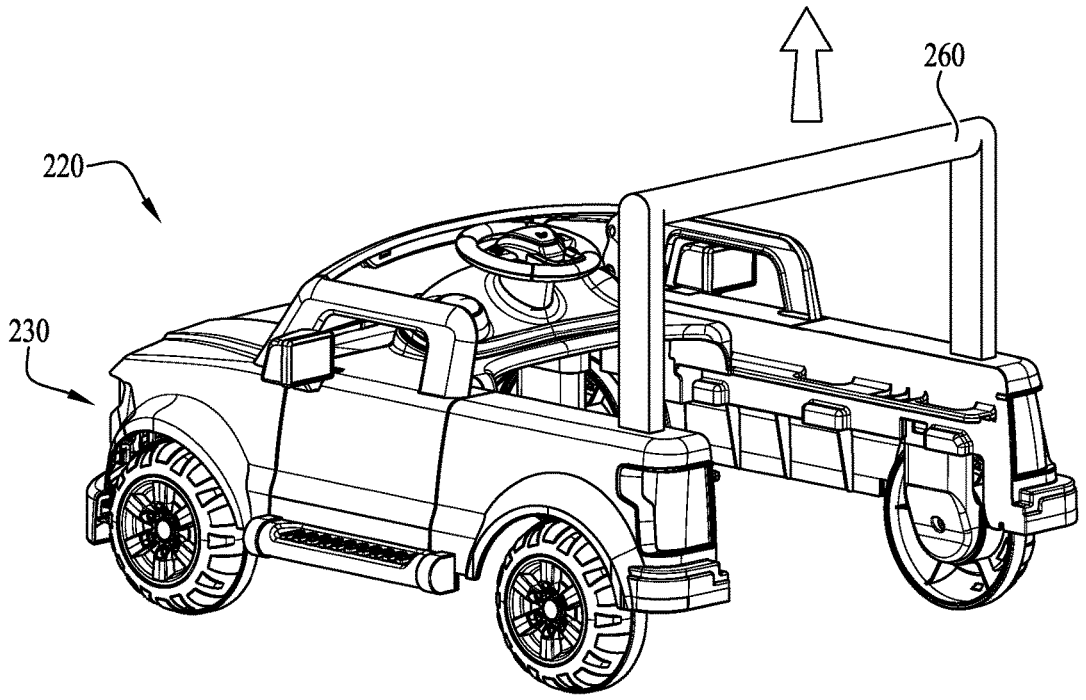

In an alternative embodiment shown in example form in FIGS. 7A and 7B, a U-shaped or C-shaped handle 260 is translationally mounted to the body 230 of the standing walker portion 220, and slides vertically upward into a raised position (FIG. 7B) and vertically downward into a lowered position. In example form, the handle 260 has a generally horizontal crossbar and generally vertical extension arms extending at right angles from both ends of the crossbar. The extension arms are received in guide channels extending through the body 230 of the standing walker portion 220 with a loose or running fit, to allow a user to easily raise and lower the handle manually. Optionally, a releasable latching or locking mechanism and/or biasing means is/are provided to retain and/or bias the handle 260 in the raised and/or lowered positions. In further embodiments, the extension arms of the handle 260 optionally include two or more telescoping segments to provide additional range of motion.

In example modes of use of the walker device 10, the standing walker portion 120 is mounted to and removed from the seated walker portion 20 by sliding the open rear section 138 of the standing walker portion onto and off of the seat platform 70 of the seated walker portion, for example, as shown in FIG. 3. In the depicted embodiment, the seat platform 70 of the seated walker portion 20 comprises fins or flanges 74 along left and right sides thereof, and the left and right side portions 134, 136 of the body 130 of the standing walker portion 120 define elongate slots or tracks 140 configured to slidingly receive the fins or flanges of the seat platform. In alternative embodiments, the orientation of the flanges and tracks may be reversed. In further alternative embodiments, the standing walker portion detachably couples to the seated walker portion by one or more snap couplings, clips, straps, or other attachment means.

Figure 5B:
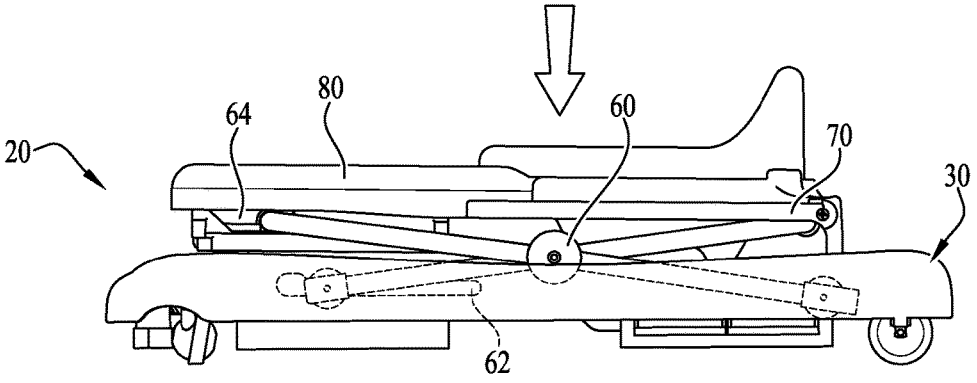
FIG. 5B shows the seated walker portion of the children's walker device of FIG. 1 in a collapsed or folded configuration, for compact storage or transport when not in use by a child.

To use the device 10 in the first seated-support mode (FIGS. 1 and 2), the handle 160 of the standing walker portion 120 is raised, and the standing walker portion is mounted by sliding it generally horizontally and linearly rearward onto the seated walker portion 20. The handle 160 is then released and lowered, whereby the rear cross-brace of the handle engages behind and against the rear of the seat 72 to retain the standing walker portion 120 in place on the seated walker portion and prevent accidental detachment. A child may then be placed into the seat 72 to use the device as a sit-in walker in the first seated-support mode (FIG. 2). To convert the device 10 for independent use of the seated walker portion 20 and/or the standing walker portion 120, the handle 160 of the standing walker portion is raised and latched, and the standing walker portion is slid generally horizontally and linearly forward (FIG. 3) to detach it from the seated walker portion. The standing walker portion 120 can then be utilized by a child independently as a walk-behind walker in a standing-support mode of use with the child using the handle 160 for support and balance as needed (FIG. 4). The seated walker portion 20 can also be used independently of the standing walker portion 120, in a second seated-support mode of use (FIG. 5A). The seated walker portion 20 can optionally further be convertible into a folded or collapsed mode of use for compact storage and transport (FIG. 5B). After the child has mastered walking, the standing walker portion 120 may continue to function as a play toy for the child, for example due to its configuration as an automobile, pickup truck or other vehicle the child may see adults operating, further extending the device's usefulness. In alternative embodiments, the standing walker portion is configured as a character, a zoo animal, or other child-friendly theme.

While the invention has been described with reference to example embodiments, it will be understood by those skilled in the art that a variety of modifications, additions and deletions are within the scope of the invention, as defined by the following claims.

What is claimed is:

1. A convertible walker device comprising:

a seated walker portion; and a standing walker portion;

wherein the standing walker portion is detachably mounted to the seated walker portion in a first seated-support mode wherein the standing walker portion is used in combination with the seated walker portion, and wherein the standing walker portion is detached from the seated walker portion in a standing-support mode of use independent of the seated walker portion; and wherein the seated walker portion is usable in a second seated-support mode independent of the standing walker portion when the standing walker portion is detached from the seated walker portion.

2. The convertible walker device of claim 1, wherein the seated walker portion is further convertible to a folded mode for compact storage and transport.

3. The convertible walker device of claim 1, wherein the standing walker portion is further convertible to a toy mode of use.

4. The convertible walker device of claim 1, wherein the standing walker portion is configured to resemble a vehicle.

5. The convertible walker device of claim 4, wherein the vehicle is selected from an automobile, a pickup truck, a transport mechanism, a character, and an animal.

6. The convertible walker device of claim 1, wherein the standing walker portion mounts by sliding onto the seated walker portion.

7. A convertible walker device comprising:

a seated walker portion; and a standing walker portion;

wherein the standing walker portion is detachably mounted to the seated walker portion in a first seated-support mode wherein the standing walker portion is used in combination with the seated walker portion, and wherein the standing walker portion is detached from the seated walker portion in a standing-support mode of use independent of the seated walker portion; and wherein the seated walker portion comprises a wheeled base, a seat platform, and a support frame extending between the wheeled base and the seat platform, wherein the support frame is attached directly to the seat platform.

8. The convertible walker device of claim 7, wherein the wheeled base of the seated walker portion comprises a front portion, a rear portion, and first and second side portions defining an open space substantially enclosed by the wheeled base.

9. The convertible walker device of claim 7, wherein the standing walker portion is configured to resemble a vehicle.

10. The convertible walker device of claim 9, wherein the vehicle is selected from an automobile, a pickup truck, a transport mechanism, a character, and an animal.

11. The convertible walker device of claim 7, wherein the standing walker portion comprises a pivotally mounted handle movable between a raised position for supporting a user walking behind the standing walker portion in the standing-support mode of use, and a lowered position for retaining the standing walker portion mounted to the seated walker portion in the first seated-support mode.

12. The convertible walker device of claim 8, wherein the standing walker portion comprises a front portion, left and right side portions, and an open rear section defining a generally U-shaped body having a clear space between the left and right side portions.

13. A walker device comprising:

a wheeled support base configured to rest on a support surface;

a support frame extending upwardly from the wheeled support base;

a seat platform supported at a height above the wheeled support base by the support frame, the seat platform comprising a support seat for supporting a user; and a body portion coupled to the seat platform;

wherein:

the seat platform comprises first sliding engagement elements;

the body portion comprises second sliding engagement elements configured to cooperatively engage with and detach from the first sliding engagement elements of the seat platform; and wherein in a first seated-support mode the body portion is detachably mounted to the seat platform by engagement of the first and second sliding engagement elements when the body portion is slid laterally onto the seat platform in a motion parallel to the support surface, and wherein in a standing-support mode of use the body portion is detached from and usable independently of the seat platform.

14. A walker device comprising:

a wheeled support base configured to rest on a support surface;

a support frame extending upwardly from the wheeled support base;

a seat platform attached directly to the support frame and supported at a height above the wheeled support base by the support frame, the seat platform comprising a support seat for supporting a user; and a body portion coupled to the seat platform;

wherein:

the seat platform comprises first sliding engagement elements;

the body portion comprises second sliding engagement elements configured to cooperatively engage with and detach from the first sliding engagement elements of the seat platform; and wherein in a first seated-support mode the body portion is detachably mounted to the seat platform by engagement of the first and second sliding engagement elements when the body portion is slid laterally onto the seat platform in a motion parallel to the support surface, and wherein in a standing-support mode of use the body portion is detached from and usable independently of the seat platform.

15. The walker device of claim 14, wherein the body portion is configured to have the appearance of a vehicle.

16. The walker device of claim 15, wherein the vehicle is selected from an automobile, a pickup truck, a transport mechanism, a character, and a zoo animal.

17. The walker device of claim 14, wherein the body portion is detachably coupled to the seat platform.

18. A walker device comprising:

a wheeled support base configured to rest on a support surface;

a support frame extending upwardly from the wheeled support base;

a seat platform attached directly to the support frame and supported at a height above the wheeled support base by the support frame, the seat platform comprising a support seat for supporting a user; and a body portion coupled to the seat platform;

wherein the walker comprises a handle translationally mounted to the seat platform, wherein the handle slides vertically upward into a raised position and vertically downward into a lower position.

19. The walker device of claim 18, wherein the handle is selected from a U-shaped handle and a C-shaped handle.

20. The walker device of claim 18, wherein the handle further comprises one or more telescoping segments to provide additional range of motion.

21. The walker device of claim 18, wherein the body portion is configured to have the appearance of a vehicle.

22. The walker device of claim 21, wherein the vehicle is selected from an automobile, a pickup truck, a transport mechanism, a character, and a zoo animal.

23. The walker device of claim 18, wherein the body portion is detachably coupled to the seat platform.

* * * * *